US005685288A

United States Patent [19]

Sibley et al.

[11] Patent Number: 5,685,288

[45] Date of Patent: Nov. 11, 1997

[54] COLLAPSIBLE PORTABLE BRANDING STOVE

[76] Inventors: Dwight Sibley, HC 67 Box 161, Nashua, Mont. 59248; James Hentges, Box 308, Wolf Point, Mont. 59201

[21] Appl. No.: 654,225

[22] Filed: May 24, 1996

[51] Int. Cl.[6] ..... F24C 3/00

[52] U.S. Cl. ..... 126/229

[58] Field of Search ..... 126/239, 237, 126/229, 402, 403, 404, 401, 231

[56] References Cited

U.S. PATENT DOCUMENTS

| | | | |
|---|---|---|---|
| 200,875 | 3/1878 | Robinson | 126/237 |
| 1,319,228 | 10/1919 | Juergens | 126/237 |
| 1,381,883 | 6/1921 | Hones | 126/237 |
| 1,401,514 | 12/1921 | Blake | 126/237 |
| 2,543,781 | 3/1951 | Jurgens | 126/229 |
| 2,621,976 | 10/1952 | Kynard | 126/229 |
| 2,637,315 | 5/1953 | Staggs | 126/229 |
| 2,822,801 | 2/1958 | Bissell | 126/229 |
| 3,724,444 | 4/1973 | Varona | 126/237 |
| 4,340,029 | 7/1982 | Kelly, Jr. | 126/237 |

*Primary Examiner*—Larry Jones
*Attorney, Agent, or Firm*—Harry M. Cross, Jr.

[57] ABSTRACT

A branding iron stove comprises a body having an upright longitudinal extent so as to provide an elongated upright heating compartment closed by upper and lower ends. The body has an elongated upright opening therethrough for providing access to the heating compartment. A first branding iron support is attached to the body and provides a first plurality of vertically spaced-apart locations for receiving and holding a plurality of branding iron rods, the first plurality of spaced-apart locations being disposed outwardly away from the body. A second branding iron support is attached to the body and provides a second plurality of spaced-apart locations disposed adjacent to the opening for receiving and holding a plurality of branding iron rods. The first and second spaced-apart locations are cooperatively constructed and arranged to receive and hold the plurality of branding irons in a vertical array of generally horizontal positions. The first and second branding iron supports are disposed relative to the opening so that branding irons placed in spaced-apart locations will be located adjacent to a first upright side of the opening.

10 Claims, 4 Drawing Sheets

COLLAPSIBLE PORTABLE BRANDING STOVE

BACKGROUND OF THE INVENTION

1. Field of the Invention

This invention relates to stoves for heating branding irons. More particularly, this invention relates to portable branding iron stoves designed to be dismantled and carried to a branding site and then reassembled for use.

2. Brief Description of the Prior Art

Portable branding iron stoves currently in use are inefficient and bulky. They are difficult to use and wasteful of fuel. Currently used branding iron stoves are heated with propane, an open propane-fueled flame being the source of heat. In a typical on-site branding operation, several branding irons must be heated simultaneously and branding irons are continually being removed for branding and replaced in the stove for reheating following use. During a branding operation, the stove must be continuously heated, requiring a continuous consumption of fuel and the consequent emission of considerable amounts of heat in and around the stove.

A typical portable branding iron stove is formed of a horizontal hollow cylinder set up on detachable legs arranged in a tripod fashion. The cylinder provides a horizontal, elongated heating chamber within which several branding iron heads can be heated at once. A propane nozzle is inserted into one end of the horizontal cylinder and the other end is closed. The cylinder side wall is cut out to provide an elongated rectangular opening that extends horizontally across the cylinder to expose the cylinder's interior heating chamber. A branding iron rod support bar having a generally U-shaped configuration is fastened to the cylinder so as to lay in a generally horizontal plane extending out from the cylinder's elongated rectangular opening. The elongated opening has a width sufficient to accommodate several branding irons at once. Branding irons rods are laid across the support bar and across the lower edge of the elongated opening so that the branding heads are located in the heating chamber without contacting the side wall of the cylinder. A source of fuel, such as a portable propane tank and supply hose, is connected to the propane nozzle, turned on, and the fuel flowing through the nozzle is ignited. The fuel flow is controlled by a dispensing valve located on the propane tank to regulate the flame issuing from the nozzle.

In order for an adequate flame to reach the opposite end of the horizontal heating chamber, a relative large fuel flow is required. Typically, the large rectangular opening causes the flame, as well as a significant portion of heated air from the flame, to be drawn out into the ambient and away from the branding iron heads. This often results in the operators being singed by the escaping flame and heat. Moreover, if the flame is reduced to minimize risk to the operators, branding irons located further away from the nozzle will not be heated to a high enough temperature. Furthermore, because range conditions on-site are often very windy, the flame issuing from the nozzle is subject to being snuffed out by a gust of wind because the horizontal opening offers little protection against wind gusts. In order to overcome flame-out problems and branding iron underheating problems, moreover, typically a specially-designed nozzle must be employed so that a stronger, higher velocity flame can be produced.

When it comes time to transport the stove, the U-shaped branding iron rod support makes the entire assembly rather bulky and awkward to move and to store. The tripod leg supports, that extend outward from the side walls of the stove's cylinder, also make the entire assembly awkward to move and to store.

SUMMARY OF THE INVENTION

An object of the present invention is to provide a portable branding iron stove that is more economical and efficient than stoves of the horizontal type. Another object is to provide a portable branding iron stove that can function with a standard propane nozzle of the type often used in farming and ranching operations. A further object is to provide such a stove that provides for uniformity of branding iron heating without discharging inordinate amounts of heat toward the operator of the stove. Still another object is to provide such a stove that is conveniently disassembled for transport and storage.

In accordance with the principles of this invention a branding iron stove comprises a body having an upright longitudinal extent so as to provide an elongated upright heating compartment closed by upper and lower ends. The body has an elongated upright opening therethrough for providing access to the heating compartment. First branding iron support means is attached to the body and provides a first plurality of vertically spaced-apart locations for receiving and holding a plurality of branding iron rods, the first plurality of spaced-apart locations being disposed outwardly away from the body. Second branding iron support means is attached to the body and provides a second plurality of spaced-apart locations disposed adjacent to the opening for receiving and holding a plurality of branding iron rods. The first and second spaced-apart locations are cooperatively constructed and arranged to receive and hold the plurality of branding irons in a vertical array of generally horizontal positions. The first and second branding iron support means are disposed relative to the opening so that branding irons placed in spaced-apart locations will be located adjacent to a first upright side of the opening.

DESCRIPTION OF THE PREFERRED EMBODIMENT

Figure 1:
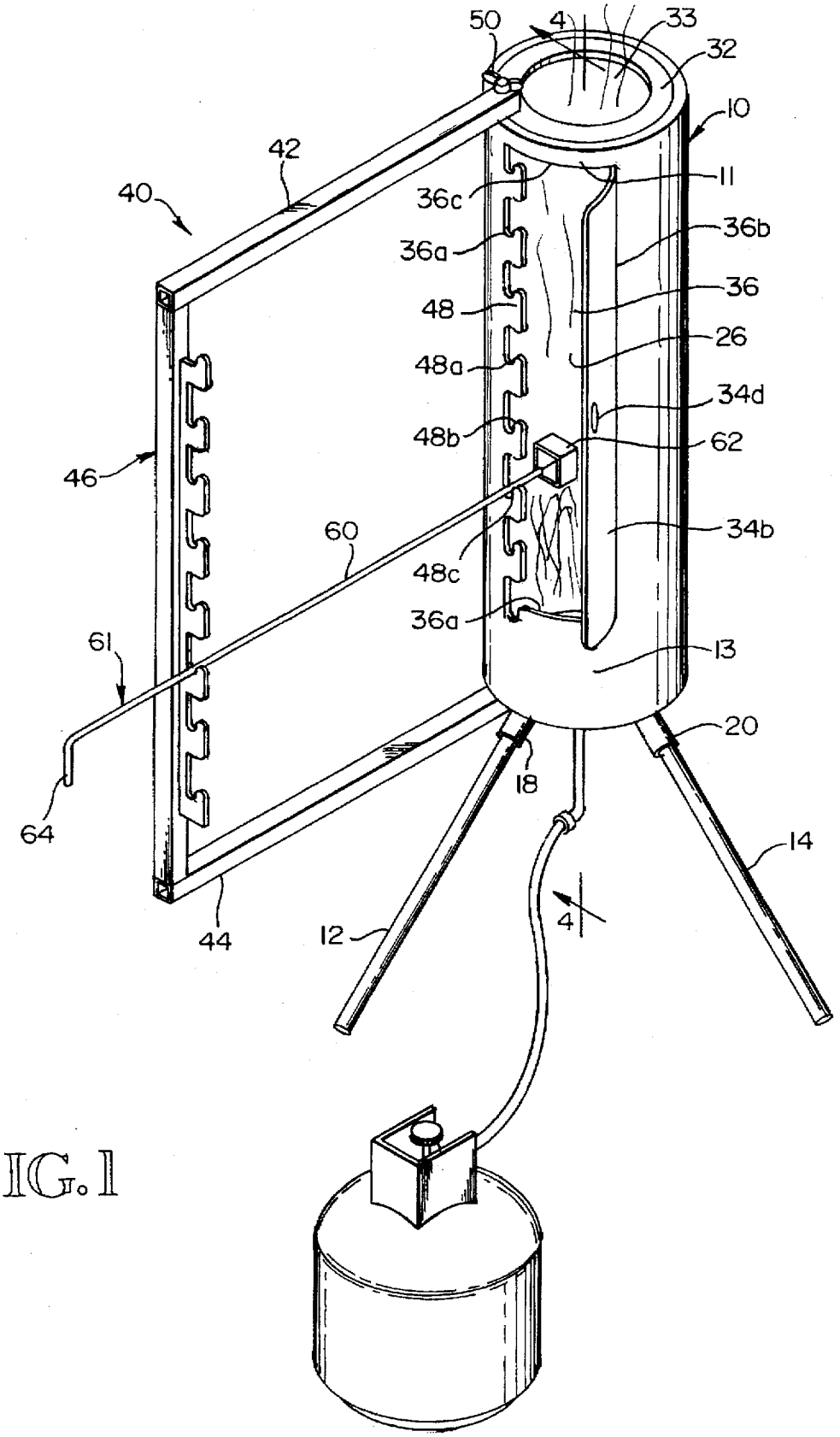
FIG. 1 is a perspective view of the portable branding iron stove of this invention as it would appear set up in the field for branding, with a portable propane tank attached by a delivery hose.
Figure 2:
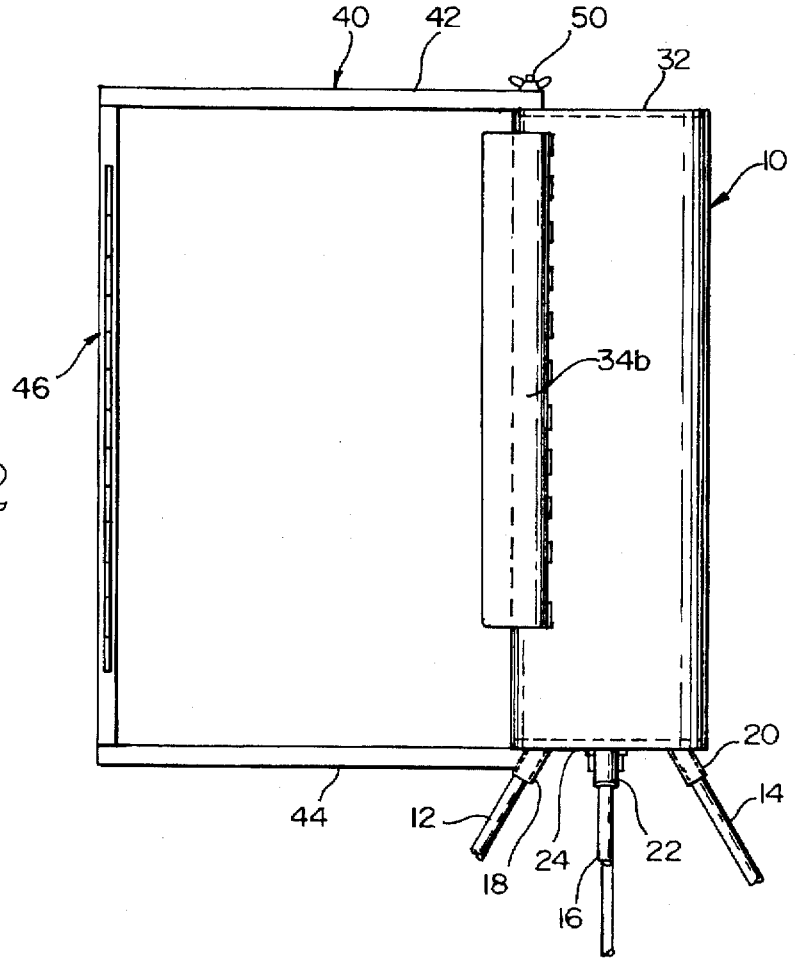
FIG. 2 is a partial vertical elevation view of the FIG. 1 stove.
Figure 3:
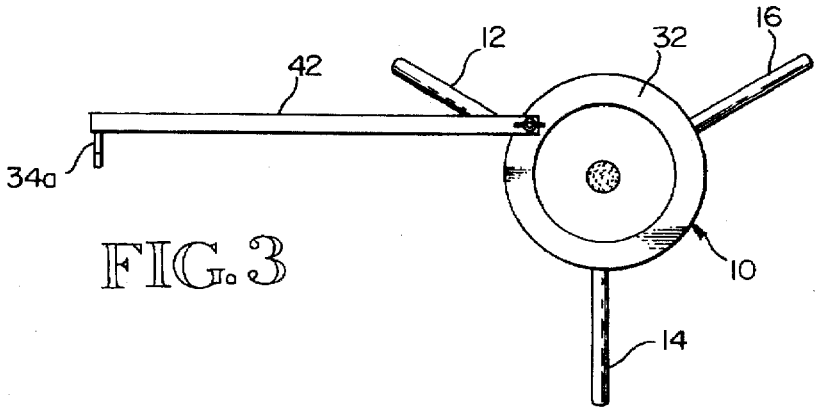
FIG. 3 is a top plan view of the FIG. 1 stove.
Figure 4:
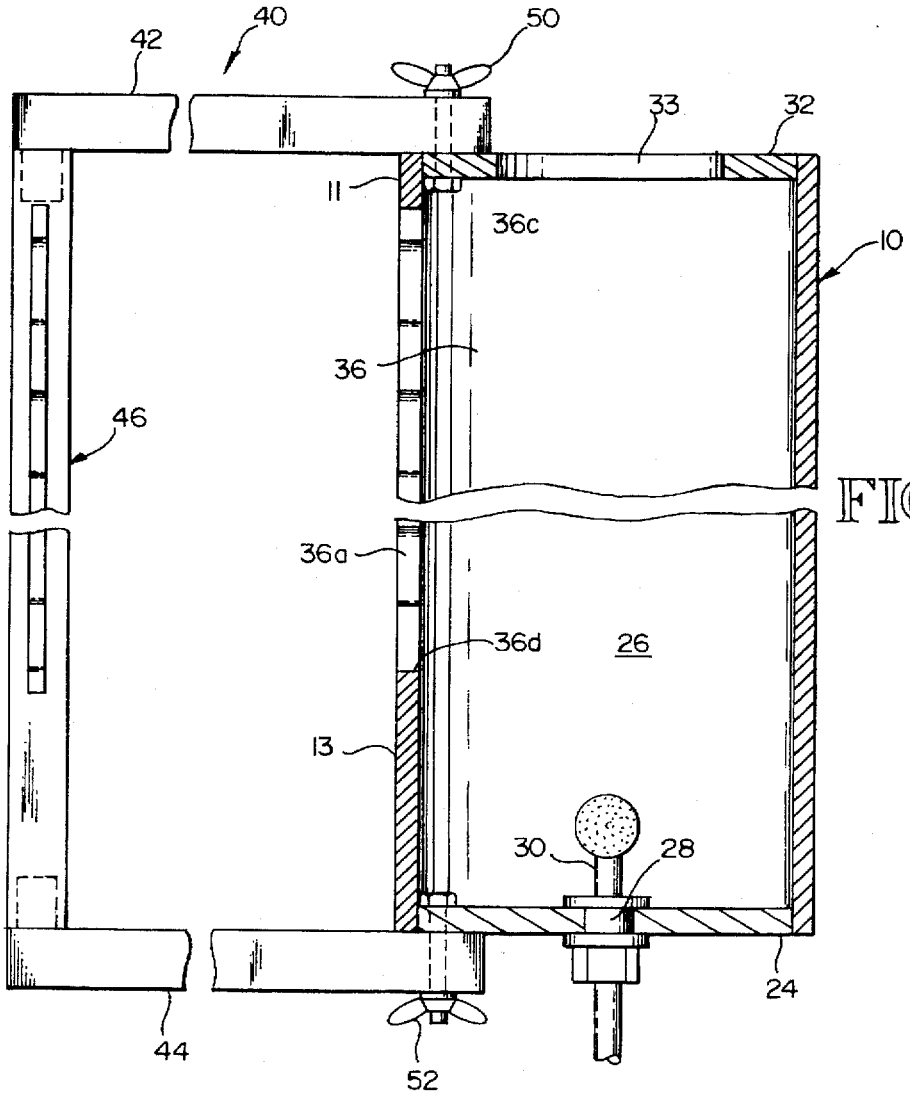
FIG. 4 is a partial vertical cross-section view of the FIG. 1 stove.
Figure 5:
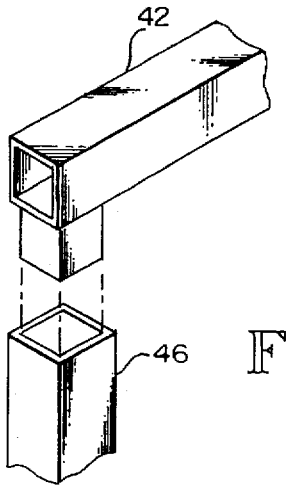
FIG. 5 is a perspective view of a detail of the FIG. 1 stove.

The portable branding iron stove of this invention comprises a vertical steel cylinder 10 that is supported by three legs 12, 14, 16 from three sockets or ferrules 18, 20, 22 attached to the bottom end wall 24 of the cylinder 10. Ferrules 18, 20, 22 are short steel tubes that are welded to the bottom end wall 24 so as to extend downward at equal acute angles from the vertical sufficient to provide a stable tripod configuration for the legs 12, 14 and 12. Legs 12, 14 and 16 are equal length steel rods or tubes having diameters suitable for slip-fitting within the ferrules. The ferrules may be provided with fasteners, such as wing screws, to lock the legs into the ferrules so that the entire assembly may be lifted and relocated without fear of the legs falling out.

The bottom end wall 24 is a circular steel plate that closes off the bottom end of the vertically-extending heating compartment 26 within the interior of the cylinder 10. The bottom end wall 24 is provided with an axial hollow fitting 28 through which a propane torch nozzle 30 can be inserted. The top end of the cylinder 10 is closed by a top end wall 32. Top end wall 32 is a steel rim having an axial circular vent opening 33 therethrough.

The side wall 34 of cylinder 10 is provided with a vertically-elongated rectangular opening 36 defined by vertical side edges 36*a*, 36*b* and top and bottom edges 36*c*, 36*d*. Top and bottom edges 36*c*, 36*d* are semi-circular. The top and bottom edges 36*c*, 36*d* are inset longitudinally inward from the cylinder bottom and top end walls 24, 32 a sufficient distance so that the intervening sections 11 and 13 of the cylinder side wall 34 are strong enough to avoid those sections 11, 13 being a structural weakness to the cylinder 10. The opening 36 is oriented in the cylinder side wall 34 such that it is positioned between two of the leg ferrules 18, 20, so that it is accessible by an operator without interference from the legs 12, 14. The third ferrule 22 is so located on the bottom end wall 24 that the third leg 16 will extend downward and outward on the opposite side of the cylinder 10 away from the opening 36.

An outrigger branding iron rod support structure 40 extends outward from the cylinder 10. Support structure 40 comprises top and bottom support members, 42, 44, that are attached to the cylinder 10 so as to extend outward from the cylinder side wall 34. A vertical outer branding iron support 46 extends vertically between the top and bottom members 42, 44 and is adapted to receive and hold the rods of several branding irons, such as branding iron 61, in a vertical arrangement. One of the vertical side edges 36*a* of opening 36 is provided with an inner branding iron rod support 48 arranged for receiving and holding the rods of several branding irons in a vertical arrangement. Supports 46 and 48 are configured and arranged so that several branding iron holding locations are provided at similar elevations so that several branding iron rods can be positioned on the supports 46, 48 in generally horizontal positions. Eight such locations are shown in FIG. 1, and three typical locations are identified as 46*a–c* and 48*a–c*), The supports 46 and 48 are arranged so that branding iron rods, such as rod 60, can be supported thereby in general radial alignment with the cylinder 10 with the branding iron heads, such as head 62, positioned about at the axial centerline of the heating compartment 26 and with the branding iron handles, such as handle 64, located outwardly of the outer support 46.

Figure 6:
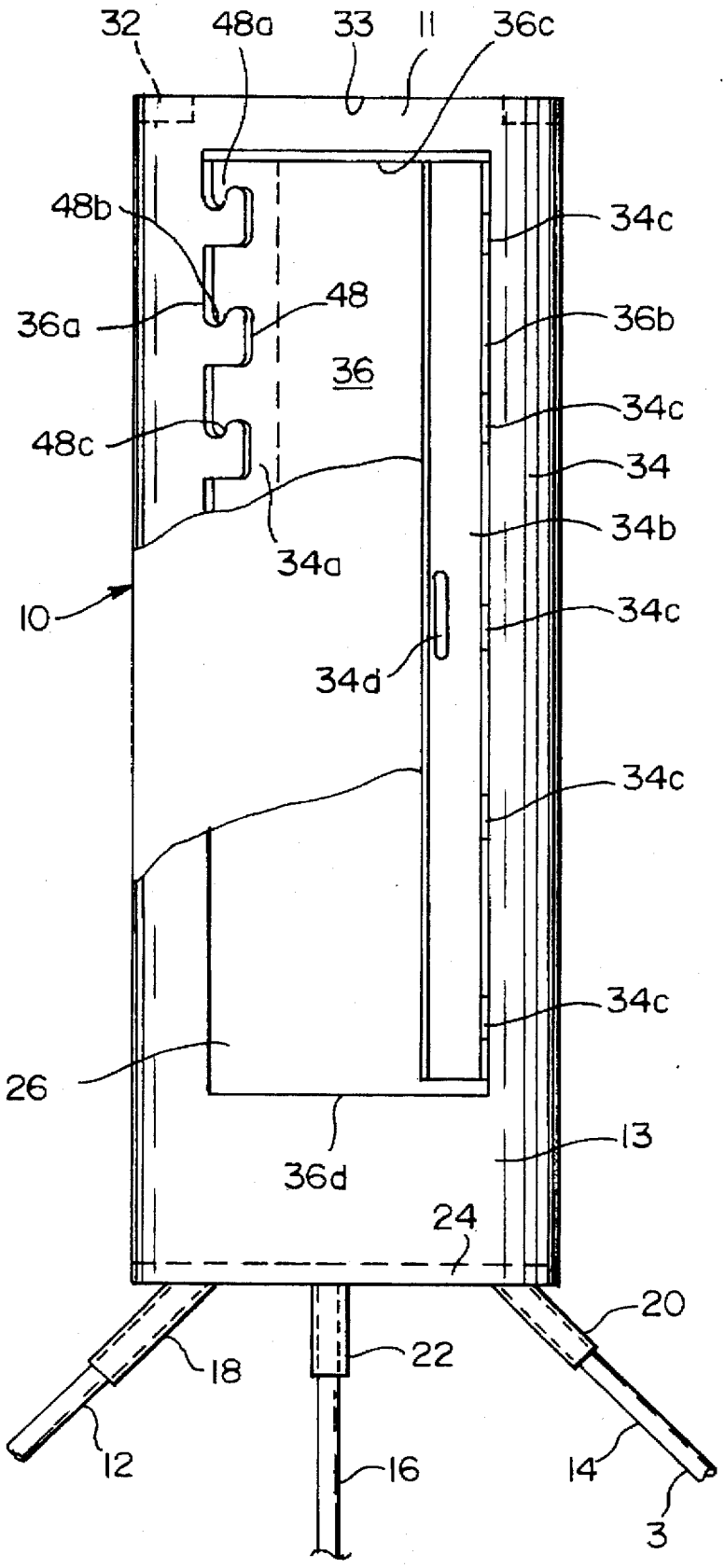
FIG. 6 is a partial elevation view of the FIG. 1 stove, illustrating the cut-out portions that make up the stove branding iron supports.

In a preferred arrangement of the structure of the supports 46 and 48, the cylinder opening 36 is formed by cutting out a first portion 34*a* of the cylinder side wall 34, such as by using a cutting torch, to produce the configuration illustrated in FIG. 6. This configuration produces a notched shape to the cylinder side edge 36*a* that becomes inner support 48. This configuration also produces an inverse notched shape to one side of the portion 34*a* which, when turned end-for-end, becomes substantially identical to the notched shape of the cylinder side edge 36*a*. The opposite side of portion 34*a* is generally linear and the ends of portion 34*a* are relatively short and semi-circular. The individual notches in side edge 36*a* become the branding iron holding locations identified in FIG. 6 as 48*a–c*. The individual notches in portion 34*a*, when portion 34*a* is turned end-for-end, become the branding iron holding locations identified in FIG. 6 as 46*a–c*. These notches, 46*a–f* and 48*a–f*, have a generally horizontal upper edge, a generally vertical inside edge, and a generally ogee-shaped lower edge of a concave/convex configuration. The lower edge of these notches is a reversed-curve arc that appears somewhat like a lying-down S with the inner part forming a concavity for holding a branding iron rod. The ogee-shaped lower edge of an upper notch connects to the horizontal upper edge of a lower notch by a generally vertical outside edge. The rounded-edge overall configuration of these notches lends them to being fabricated by a cutting torch.

An important feature of the stove of this invention, is the provision of the branding iron supports at one side of the opening 36. This arrangement leaves the majority of the width of opening 36 free and clear. Therefore, branding irons can be shifted into and out of the stove heating compartment 26 without interference from other branding irons that are carried by the supports. In operation, a branding iron head would be inserted through the opening 36 and then shifted to one side of the opening for placement into the supports 42, 44. Because the branding iron heads are bulky and often have complex structural configurations, the ability to place the branding irons to one side of the opening greatly simplifies the accessibility of the heating compartment. As a consequence, for a given height more branding irons can be heated at one time without risk that the branding iron heads might become entangled.

In a preferred arrangement of the support structure 40, the top and bottom support members 42, 44 are formed of steel tubes that are detachably fastened to the top and bottom ends, 32, 24, of cylinder 10 by connectors 50, 52. Suitable connectors 50, 52 could be threaded shafts extended outward from the respective cylinder ends and through holes in the inner ends of the members 42, 44, and wing nuts threaded onto the exposed shafts to clamp the members 42, 44 to the cylinder ends 32, 24. Alternately, the connectors 50, 52 could be provided as wing bolts threaded into nuts welded to the undersides of the bottom and top walls 24, 32. The latter arrangement might be preferred because that there would be no bolt ends protruding outward from the top and bottom walls to snag or catch on other objects during shipment or storage.

The vertical branding iron rod support 46 comprises a steel tube that is held between the top and bottom members 42, 44 by steel pins that are extended from the outer ends of members 42, 44 into apertures in the ends of support 46. Support 46 also comprises portion 34*a* that has been turned end-for-end and welded to one side of support 46. This arrangement of the support structure 40 enables the structure to be disassembled by removing the wing nuts of connectors 50, 52, lifting the top and bottom members 42, 44 from the threaded shafts of connectors 50, 52, and then pulling the connector pins of the top and bottom members 42, 44 from engagement with the ends of the vertical support tube 46. The disassembled support structure 40 can be reassembled by reattaching the top and bottom member connector pins into the ends of the vertical support tube 46, placing the inner ends of the members 42, 44 over the threaded shafts of connectors 50, 52, and securing the assembly in place with the wing nuts of connectors 50, 52.

Also in a preferred arrangement, a second portion 34*b* of the cylinder side wall 34, remaining after the first portion 34*a* is cut out, is cut out at the top and bottom and bent outward to an approximate radial orientation to serve as a wind baffle. To facilitate bending portion 34*b* outward, several slots may be flame cut into the inner edge of portion 34*b* to leave integral tabs 34*c* to serve as hinge points about which the portion 34*b* can be bent to form the wind baffle. At a midpoint along the outer edge of portion 34*b*, a finger slot 34*d* can be cutout so as to provide a hand grip for carrying the stove cylinder 10 when the stove is disassembled.

When the stove elements are disassembled, the legs 12, 14 and 16, and the members 42, 44 and 46 of support structure 40 can be placed longitudinally in the heating compartment 26 for storage therein. The cylinder 10 can then be picked up by gripping the wind baffle portion 34*b*, employing the finger cutout 34*d*, and carried away for storage or relocation. The legs and support structure members are selected to have lengths short enough that these elements can be placed within and stored within the heating compartment 26. The circular plate of the bottom end 13 and the plate rim of the top end 11 will insure that these elements will not fall out of the heating compartment when the disassembled stove is transported.

In operation, a standard propane torch nozzle can be inserted through the torch fitting 28 and secured therein by any suitable means, and ignited. The flame will naturally rise, heating the entire heating compartment 26 to a uniform temperature, with heated air drawn through the vertical side opening 36 and up through the heating compartment to vent out through the top end wall vent opening 33. The natural draft of this vertically-upright stove arrangement will result in uniform heating of branding iron heads all along the length of the heating compartment 26. The natural draft of this arrangement will also mitigate against excessive heat being ejected outward through the opening 36. Flame outs will be much less likely due to the natural upward draft. Furthermore, the wind baffle effect of portion 34*b* will further mitigate against the likelihood of flame outs. Due to its upright, vertical arrangement, the stove can be easily turned so that any prevailing ambient wind or wind gust conditions can be baffled by portion 34*b*.

As an alternative to the preferred arrangement and structure of the supports 42, 44 and the portions 34*a* and 34*b*, the inner and outer branding iron supports could be fabricated from steel parts independently of the cylinder structure. The cylinder opening 36 could be cut out to form a substantially rectangular configuration with both vertical edges 36*a*, 36*b* being substantially linear. An appropriate branding iron rod-holding bracket structure, providing holding notches, could be welded to the vertical outer support tube of support 46. Likewise, an appropriate branding iron rod-holding bracket structure, providing holding notches, could be welded to the cylinder 10 so as to protrude slightly beyond the vertical edge 36*a* of opening 36. Rather than bending a portion 36*b* outward to provide a wind baffle, a separate baffle plate could be attached to the cylinder 10 adjacent the vertical edge 36*b* of opening 36 to provide a wind-baffling function.

While the preferred embodiment of the invention has been described herein, variations in the design may be made. The scope of the invention, therefore, is only to be limited by the claims appended hereto.

The embodiments of the invention in which an exclusive property is claimed are defined as follows:

I claim:

1. A branding iron stove which comprises a body having an upright longitudinal extent so as to provide an elongated upright heating compartment closed by upper and lower ends, said body having an elongated upright opening therethrough for providing access to said heating compartment; first branding iron support means attached to said body and providing a first plurality of vertically spaced-apart locations for receiving and holding a plurality of branding iron rods, said first plurality of spaced-apart locations being disposed outwardly away from said body; and second branding iron support means attached to said body and providing a second plurality of spaced-apart locations being disposed adjacent to said opening for receiving and holding a plurality of branding iron rods; said first and second spaced-apart locations being cooperatively constructed and arranged to receive and hold the plurality of branding irons in a vertical array of generally horizontal positions; and said first and second branding iron support means being disposed relative to said opening so that branding irons placed in spaced-apart locations will be located adjacent to a first upright side of said opening.

2. The stove of claim 1 wherein said upper end is provided as a rim having a vent opening therethrough; and wherein said lower end is provided with a propane nozzle opening.

3. The stove of claim 1 wherein said first branding iron support means comprises upper and lower members attached to said upper and lower ends, respectively, and cantilevered therefrom, and a branding iron support extending vertically between said upper and lower members when said stove is positioned uprightly for operation.

4. The stove of claim 3 wherein said upper and lower members are detachably attached to said upper and lower ends, and wherein said upper and lower members are detachably attached to said branding iron support so that said upper and lower members and said support may be disassembled from one another and from said body for placement and storage within said heating compartment.

5. The stove of claim 1 including a plurality of legs for supporting said body in an upright position, and a plurality of leg connectors on the lower end of said body for attaching said legs to said body.

6. The stove of claim 1 wherein said upper end is provided as a rim having a vent opening therethrough; and wherein said lower end is provided with a propane nozzle opening; and wherein said first branding iron support means comprises upper and lower members attached to said upper and lower ends, respectively, and cantilevered therefrom, and a branding iron support extending vertically between said upper and lower members when said stove is positioned uprightly for operation.

7. The stove of claim 6 wherein said upper and lower members are detachably attached to said upper and lower ends, and wherein said upper and lower members are detachably attached to said branding iron support so that said upper and lower members and said support may be disassembled from one another and from said body for placement and storage within said heating compartment.

8. The stove of claim 6 including a wind baffle extending outward from said body adjacent to a second upright side of said opening opposite to said first upright.

9. The stove of claim 7 including a plurality of legs for supporting said body in an upright position, and a plurality of leg connectors on the lower end of said body for attaching said legs to said body.

10. The stove of claim 1 including a wind baffle extending outward from said body adjacent to a second upright side of said opening opposite to said first upright.

* * * * *